US007185673B2

(12) United States Patent
Hodges

(10) Patent No.: US 7,185,673 B2
(45) Date of Patent: Mar. 6, 2007

(54) SAFETY DEVICE FOR FLUID OPERATED MACHINES

(76) Inventor: Murray Andrew Hodges, 100 Cadles Road, Carrum Downs 3201, Victoria (AU)

( * ) Notice: Subject to any disclaimer, the term of this patent is extended or adjusted under 35 U.S.C. 154(b) by 0 days.

(21) Appl. No.: 10/482,450

(22) PCT Filed: Jul. 2, 2002

(86) PCT No.: PCT/AU02/00923

§ 371 (c)(1),
(2), (4) Date: Dec. 30, 2003

(87) PCT Pub. No.: WO03/004194

PCT Pub. Date: Jan. 16, 2003

(65) Prior Publication Data

US 2004/0168729 A1 Sep. 2, 2004

(30) Foreign Application Priority Data

Jul. 2, 2001 (AU) ..... PR6161

(51) Int. Cl.
*B21D 55/00* (2006.01)

(52) U.S. Cl. ..... 137/596.16; 91/424

(58) Field of Classification Search ..... 91/424; 137/596.16

See application file for complete search history.

(56) References Cited

U.S. PATENT DOCUMENTS

| | | | | |
|---|---|---|---|---|
| 3,135,289 | A * | 6/1964 | Jordan | 137/596.16 |
| 4,227,547 | A * | 10/1980 | Cameron | 137/596.16 |
| 5,484,352 | A | 1/1996 | Kuma | |
| 5,799,561 | A * | 9/1998 | Wetzel et al. | 91/424 |
| 5,912,795 | A | 6/1999 | Wetzel et al. | |

FOREIGN PATENT DOCUMENTS

| | | |
|---|---|---|
| EP | 0 309 809 | 5/1989 |
| EP | 0 780 743 | 6/1997 |
| EP | 0 782 057 | 7/1997 |
| EP | 0 797 035 | 9/1997 |
| EP | 1 059 460 | 12/2000 |
| FR | 2373007 | 6/1978 |
| GB | 2 217 917 | 11/1989 |
| WO | 00/68610 | 11/2000 |

* cited by examiner

*Primary Examiner*—Stephen M. Hepperle
(74) *Attorney, Agent, or Firm*—Smith-Hill and Bedell

(57) ABSTRACT

The supply of operating air or oil to a press, shears or like machine is controlled by a pair of spool valves connected in series and each operates a pair of switches. The switches connect DC current to the solenoids via external relays which open and close the valves. The external relays are standard components on the switchboard of the machine subject to control. Sharing the control between two valves allows malfunction in either valve to indicate the system needs correction while at the same time preventing supply to the machine. The switches are coupled to the DC switchboard of the machine by cables and thus can be retrofitted.

14 Claims, 6 Drawing Sheets

SAFETY DEVICE FOR FLUID OPERATED MACHINES

FIELD OF THE INVENTION

This invention concerns safety devices of the type used to protect users of hydraulic, water, steam or pneumatic machinery with guards which move in and out of working positions in concert with a START signal.

BACKGROUND OF THE INVENTION

Presses, shears and other large equipment where work pieces are fed in and out of the closing parts are commonly powered by compressed air, water, steam or hydraulics. The machine may be ready to close but will not do so until the guard moves to the protecting position and the operator actuates START. There is commonly an electrical safety circuit incorporating an emergency STOP which permits operation of a valve which in turn admits fluid to begin closing the machine parts on the work piece. Occasionally the fluid valve fails to close fully and this condition may go undetected until an accident draws attention to it.

If a pair of valves are used to reduce the risk of failure, it is found in practice that if one of the valves malfunctions and sticks in the OPEN position, the remaining valve may continue independently leaving the operator unaware that the system needs investigation. When the second valve fails and an accident follows, it is at that stage that the failure of both valves is discovered. In production work where the machine fails to respond to a START signal and then to a RESET signal, it is useful if some indication be given to the maintenance engineer which component to check. If the system does not monitor the condition of the valves a comprehensive diagnostic procedure is required and this adds to the downtime.

Safety circuits in the art attempt to deal with the danger, but effectiveness depends firstly on adapting a device to the existing circuitry, and secondly upon meeting prevailing standards and obtaining accreditation from safety authorities where applicable. Industry regulations commonly stipulate the use of well tried components and any safety equipment gains approval only if it is built up from such components. Thus the relays, switches, power supplies and the like must all be approved and any advance in safety can only proceed through the interaction of such predictable components.

SUMMARY OF THE INVENTION

The apparatus aspect of the invention provides safety apparatus for controlling the supply of pressure fluid to a machine, comprising two valves connectable in series capable of controlling the supply of pressure fluid to a machine in response to a START signal, and means to detect a malfunction in either valve, whereby supply in response to a further START signal is prevented.

The means may be a dual circuit switch for each valve arranged to supply current for initiating valve operation only when both valves are in the HOME position. In use a positive driven switch for each valve is arranged to ensure that the non-return of the switch of either valve to its HOME position prevents the circuit from responding to START. The device may be used with a monitoring circuit, which may be a logic circuit or a microprocessor. This type of safety device works easily with spool valves where the spool motion signals the condition of the valve, namely whether it is closing fully when de-energised. Clearly the device will operate with motorised valves and their mechanical equivalents.

The valve operated switches may be connected by cable to a common safety relay of the type approved by the safety authority, which relay controls the supply of dc to the solenoids. This control may be refined by the insertion in series of an emergency STOP relay and a guard relay, but some machines do not have these features. We have found it more practical to make the cable connections compatible between the valve switches and the switchboard connections of the machine.

PREFERRED ASPECTS OF THE INVENTION

When the valves are de-energised, the circuit associated with each monitoring circuit monitors its inputs for short circuits and earth faults. Preferably one circuit is at positive potential and the other circuit is negative in each switch.

The switches may be positively driven limit switches operated by the valve spools. Preferably they are dual positively driven limits. The dual monitoring circuits have several sets of normally open feedback loops allowing the device to easily integrated into existing connections common to safety guard and emergency stop circuits.

Preferably the components are duplicated to counteract component failure and incorporating a single reset circuit. The valves may handle 400–1000 kPa.

BRIEF DESCRIPTION OF THE VIEWS OF THE DRAWINGS

Certain embodiments of the invention are now described with reference to the accompanying drawings in which:-

DETAILED DESCRIPTION WITH RESPECT TO THE DRAWINGS

Figure 1:
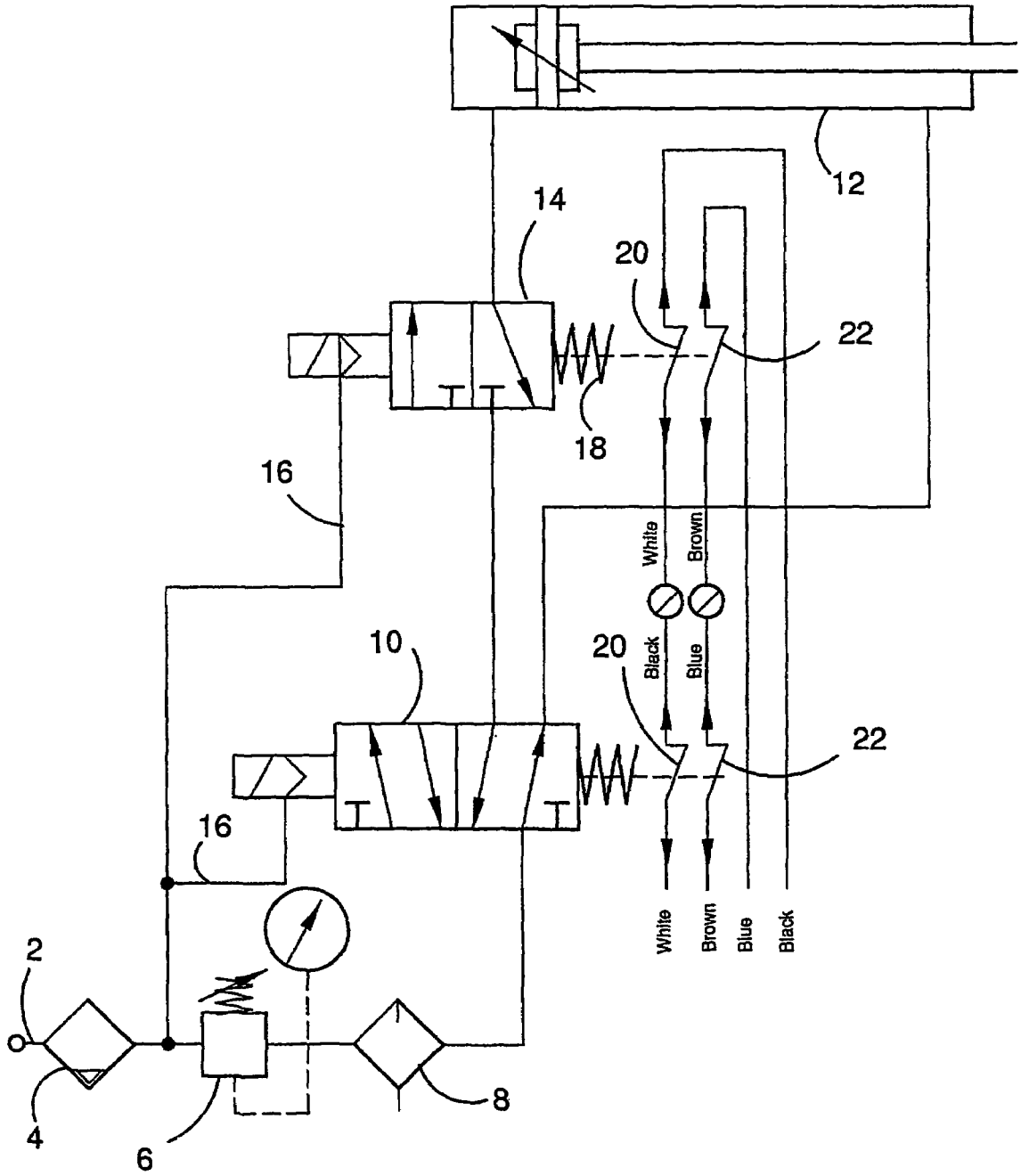
FIG. 1 is a diagram of the fluid connections using a 3 port valve and a 5 port valve in the unactuated mode.
Figure 4:
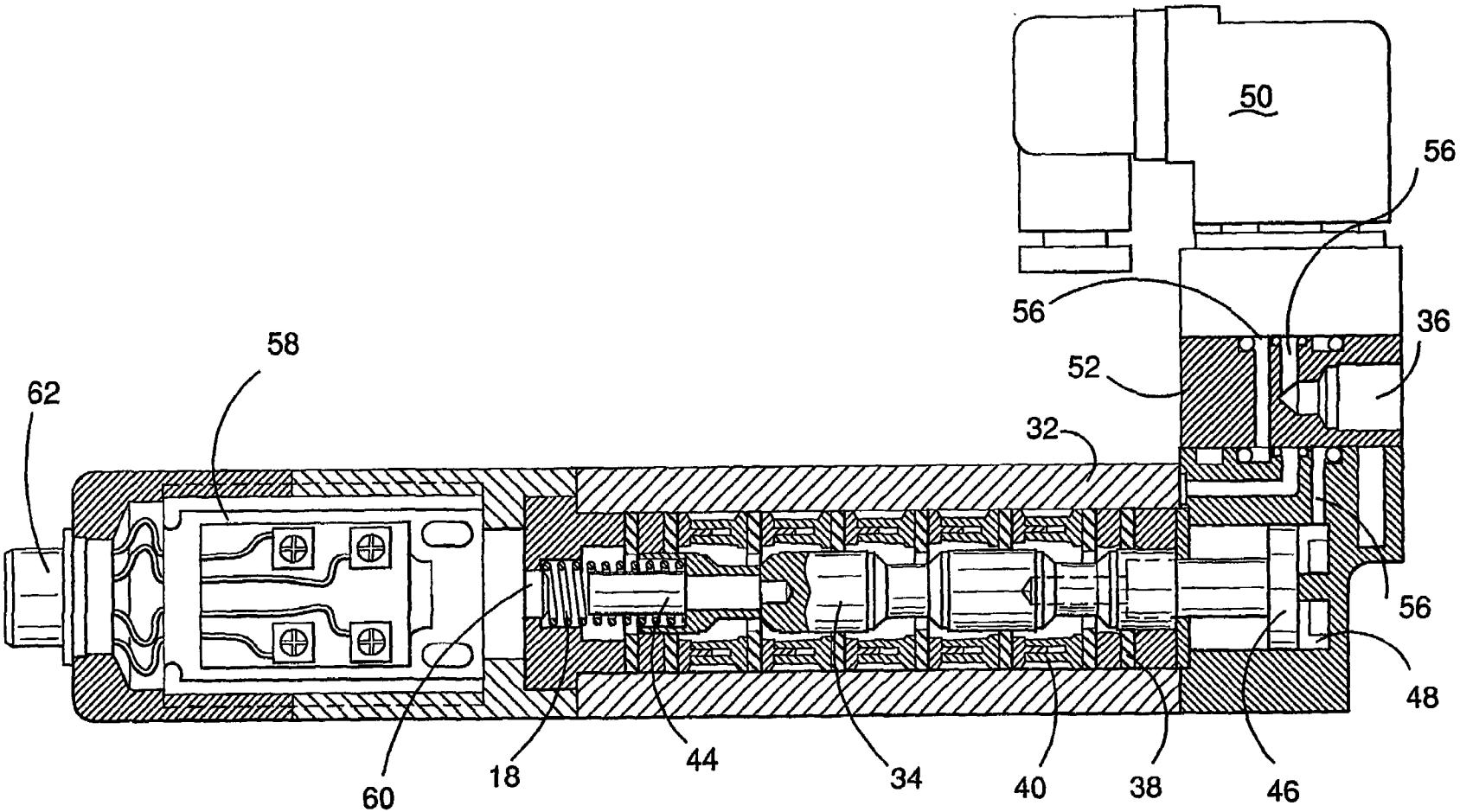
FIG. 4 is a cross section of a valve of the type shown in FIGS. 1–3.

Referring to FIG. 1, the bulk pneumatic line 2 contains filter 4, regulator 6 and lubricator 8. The line conducts air supply to a five port VG-52 spool valve 10 to one side of a double acting ram 12. The opposite side of the ram is connected to a VG-32 three port spool valve 14. Pilot supply 16 and an energising coil (not shown) actuate both valves and returns springs 18 return the valves to the HOME positions (see also FIG. 4).

The valves each open and close a two pole positive driven plunger limit switch 20, 22. Each valve has a prewired four core lead WHITE, BROWN, BLUE, BLACK.

Figure 2:
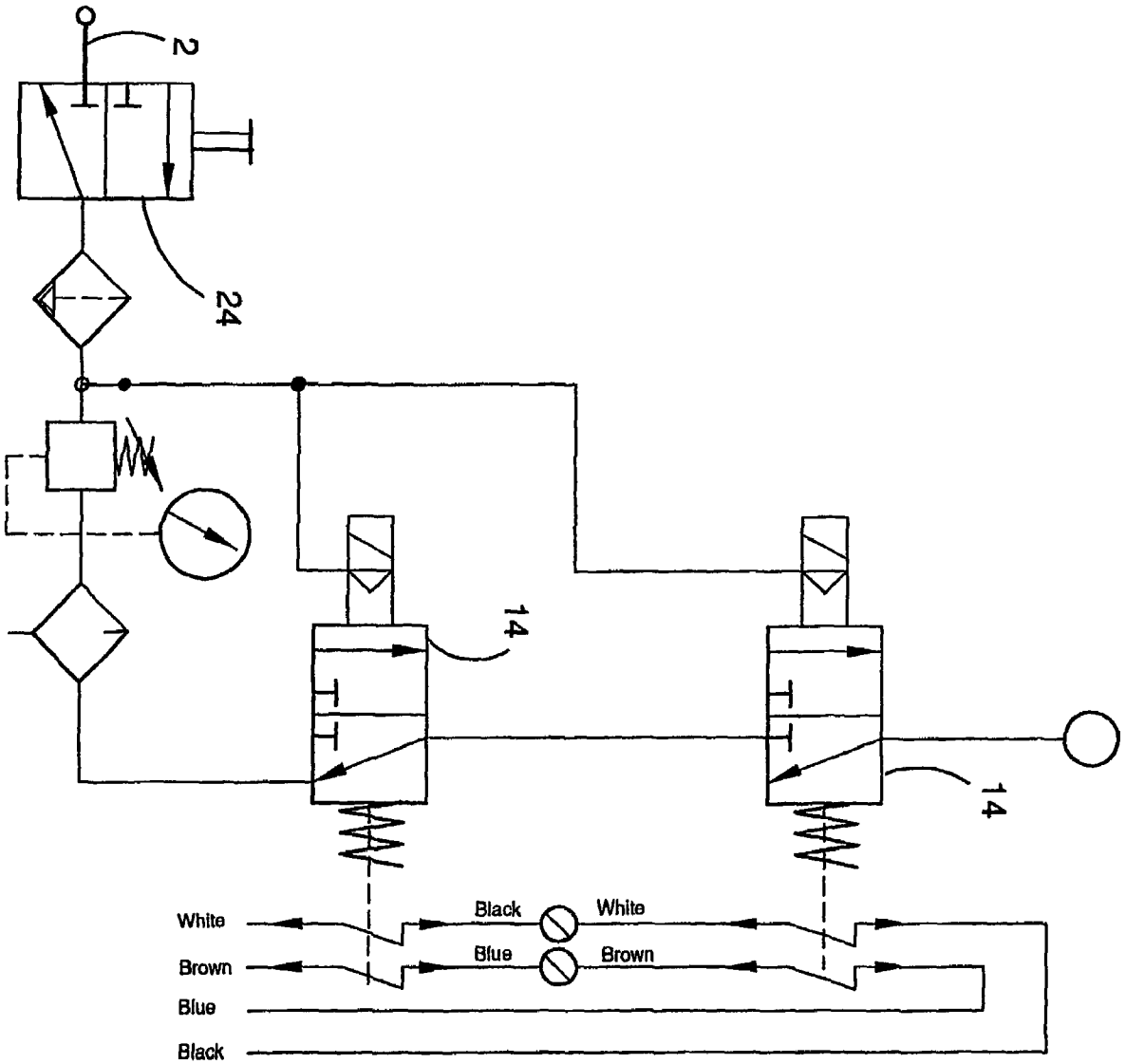
FIG. 2 is a diagram of the fluid connections using a pair of 3 port valves in the dump configuration.

In FIG. 2, the machine has no double acting ram and has instead a bank of blow moulding stations (not shown). The apparatus consists of a pair of three port valves 14 which alternately connect the machine to supply/dump. The supply is switched on and off by lockout valve 24.

Figure 3:
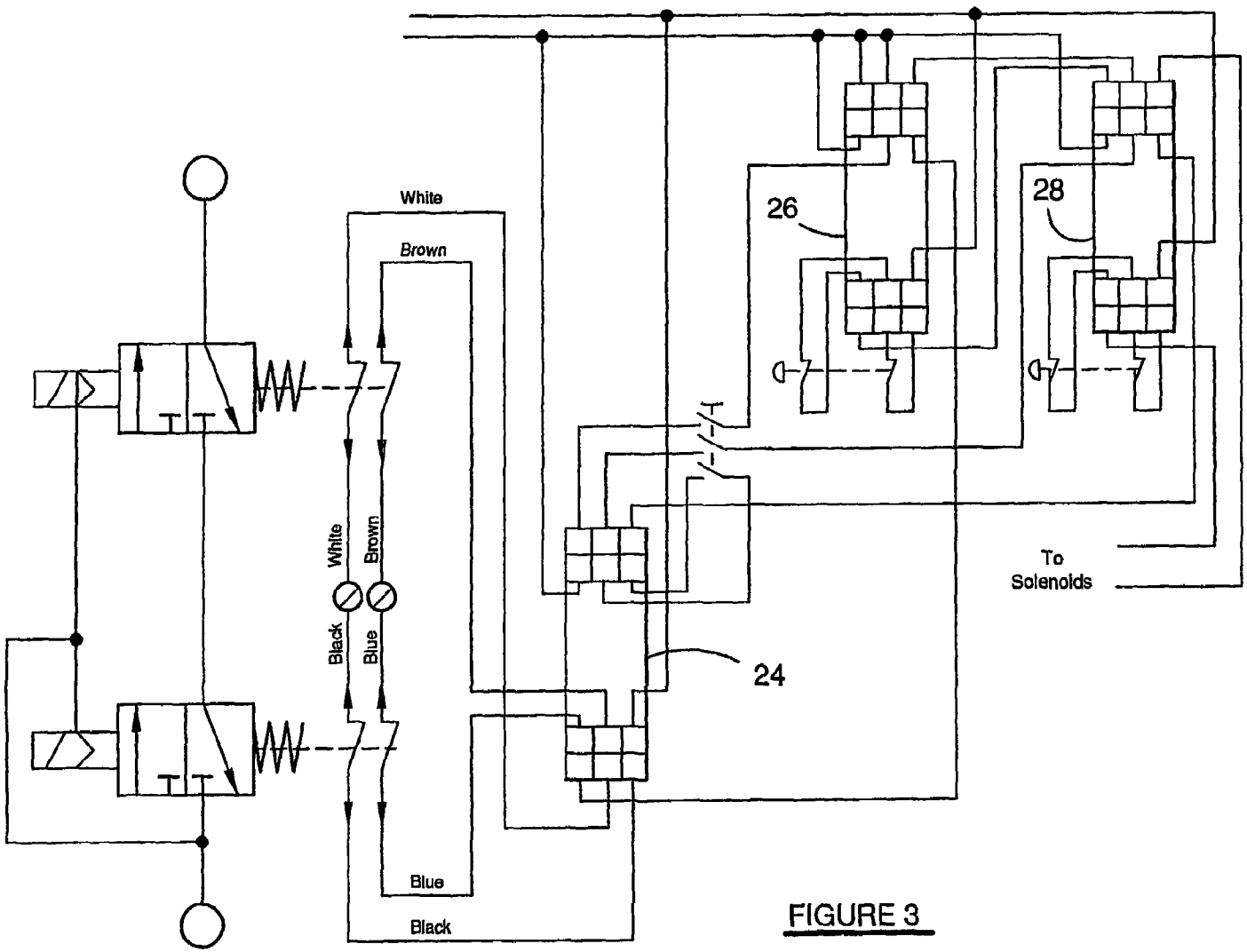
FIG. 3 is a diagram of the fluid connections and the interface with the emergency STOP relay, guard relay and safety relay.

In FIG. 3, the arrangement of FIG. 2 is shown with the four leads from the twin pairs of limit switches connected to a certified safety relay 24 forming part of the machine controller which relay in turn monitors both valves for cross short circuits of the switch and sequential operation of both valves and simultaneous operation if incorporated into the design when an additional safety relay is used. In this design the controller includes an emergency stop relay 26 and a machine guard relay 28. These allow interruption of the 24v dc supply provided with the machine to the solenoids 30 (see FIG. 4) of the spool valves. In some machines the controller will incorporate auto or manual RESET. The circuits in the controller can indicate to the maintenance staff which component is responsible when the system indicates failure.

Referring now to FIG. 3, the valve body 32 and spool 34 are made of aluminium. The port 36 is quarter inch BSP. The nitrile rubber seals 38 are braced by aluminium and plastic spacers 40. The spool return spring 18 surrounds the push rod 44. The spool piston 46 lies in chamber 48. The 12TSR3/2S-7027 coil 50 is bolted to an acetal housing 52 which has pilot air port 36 and a passage 56 which is opened and closed by the solenoid armature (not shown) the body 58 of a Ci34 GUARDMASTER switch is mounted in the return spring end of the spool body. The plunger 60 opens and closes the contacts (not shown) when activated by the push rod. The four cores 62 BLUE, WHITE, BROWN, BLACK pass out of the switchbody to an M12 four pin socket 62. The spool travel is 13 mm but the spool moves 8 mm before the machine is connected to the air supply. In the final 5 mm of travel push rod 44 presses the plunger 60. Plunger 60 is returned by a switch spring (not shown).

In use, the valve operating times are 48 milliseconds on activation and 68 milliseconds on deactivation. If the system is arranged to expect simultaneous operation, such lag times allow the valves to operate without shutting down the machine. At rest both valves in FIG. 3 are in the HOME position with the machine connected to exhaust and both valves preventing access to the air supply. The switches are accordingly also both closed.

Figure 5:
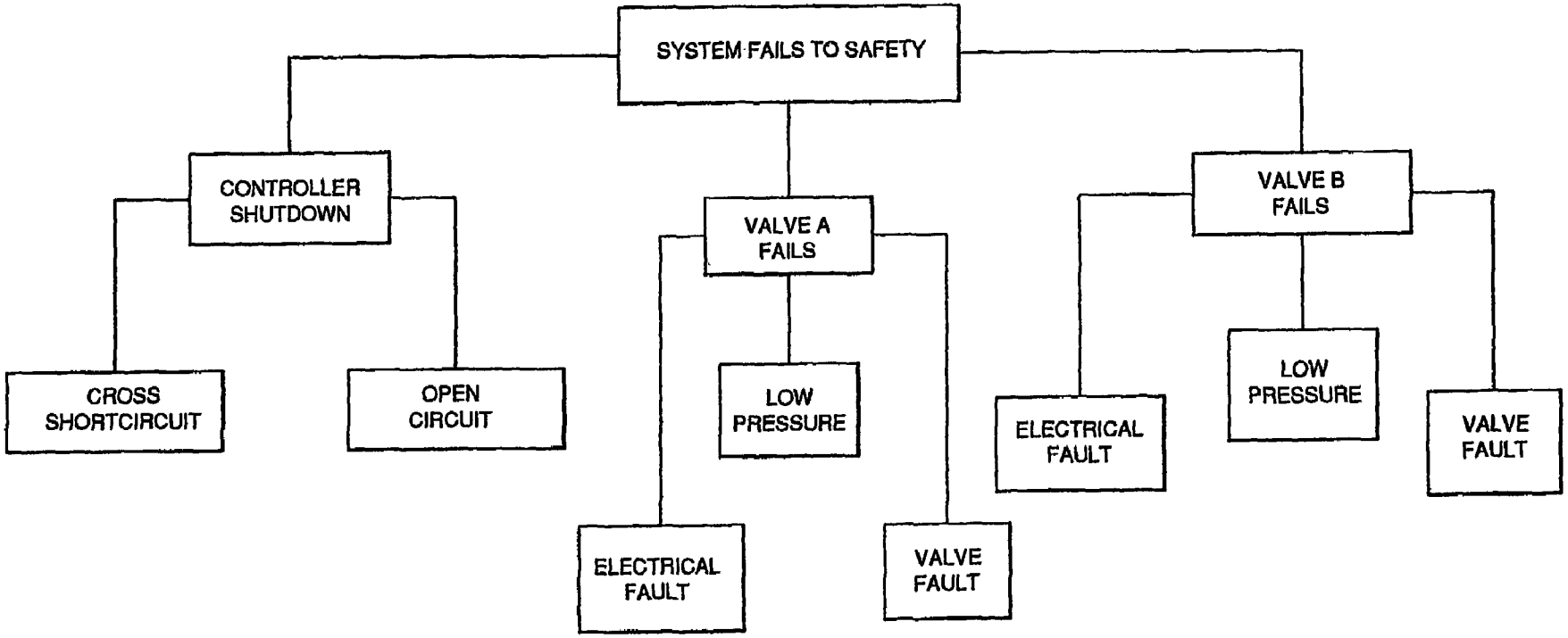
FIG. 5 is a scheme showing how the system fails to safety.
Figure 6:
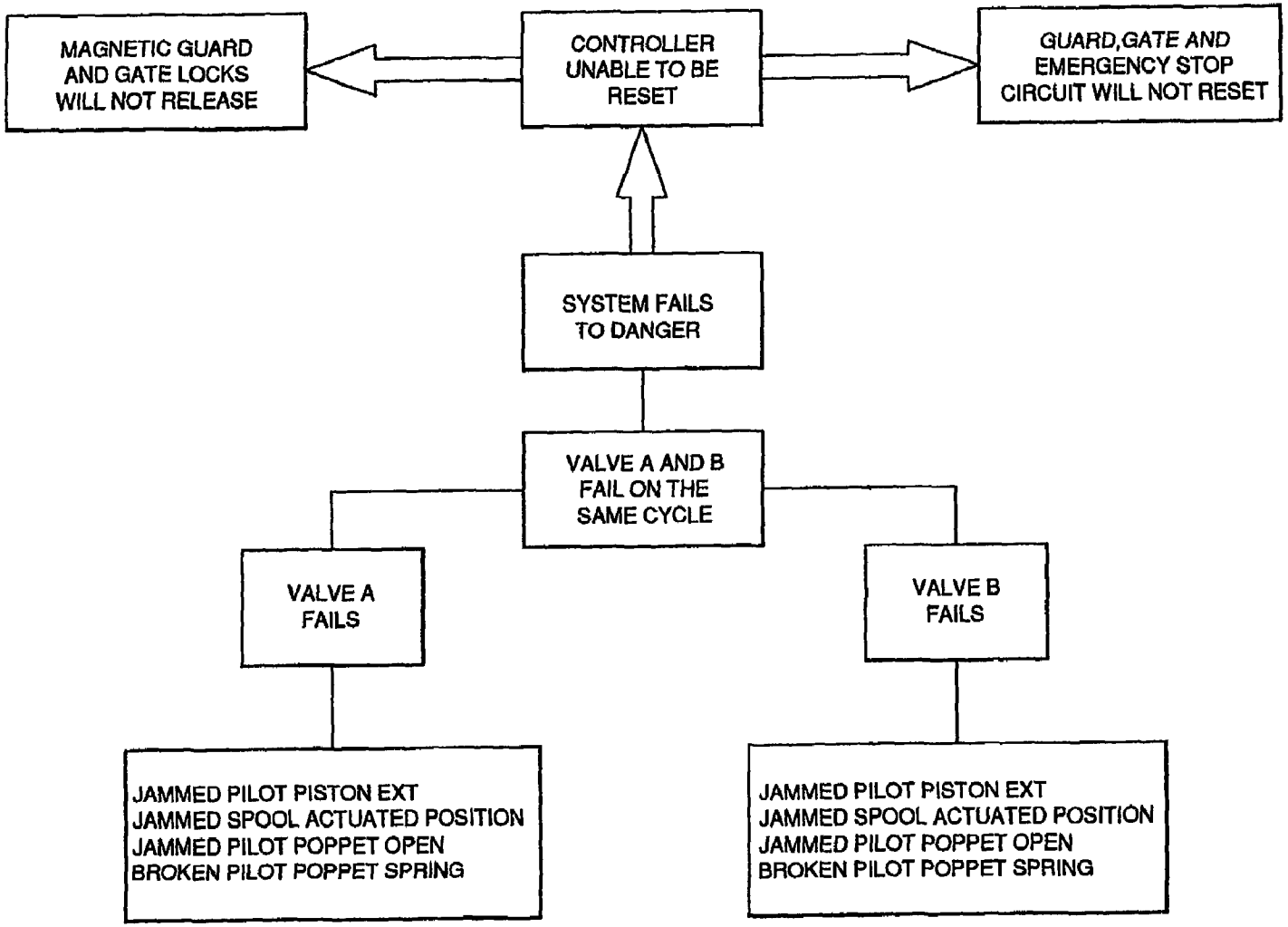
FIG. 6 is a section showing how the system indicates a fault to be investigated.

When a START signal impresses 24v on the controller circuit and the RESET switch, emergency stop relay 26 and guard relay switches 28 are all closed, the solenoids actuate both valves synchronously and the valves disconnect the machine from exhaust and connect it to air supply. Supply continues until the solenoid voltage is switched OFF by the machine. The pilot air pressure collapses and the return springs return the valves to the HOME position. The switches re-close. If one of the valves fails due to any of the faults shown in FIGS. 5 or 6, the machine will not respond to a fresh START or RESET command. Circuit checks will reveal the nature of the stoppage. A faulty valve may be uncoupled and a replacement valve installed. If the switches fail through cross short circuits or open circuits, the controller shuts down.

Relays 26 and 28 depend on relay 24 for RESET and the completion of each cycle.

We have found the advantages of the above embodiments to be:-

1. Safety is increased by sharing the risk of failure between two valves rather than one.
2. The apparatus utilises existing components of proven dependability and accordingly achieves safety authority approval.

It is to be understood that the word comprising as used throughout the specification is to be interpreted in its inclusive form, ie. use of the word comprising does not exclude the addition to other elements.

It is to be understood that various modifications of and/or additions to the invention can be made without departing from the basic nature of the invention. These modifications and/or additions are therefore considered to fall within the scope of the invention.

The invention claimed is:

1. Safety apparatus for controlling the supply of pressure fluid to a machine, comprising two valves connectable in series capable of controlling the admission of pressure fluid to the machine in response to a START signal and means comprising a positive driven double switch for each valve to detect a malfunction in either valve, whereby supply in response to a further START signal is prevented, wherein the valves are solenoid operated spool valves or solenoid operated pilot actuated spool valves.

2. Safety apparatus as claimed in claim 1, wherein the means is arranged to permit the supply of current for initiating valve operation only when both valves are in a HOME position.

3. Safety apparatus as claimed in claim 1, wherein the spool valve is part of an assembly, comprising a housing located between the solenoid and the spool valve, an inlet in the housing for pilot air, a passage connecting the inlet to a spool valve piston chamber, and an armature valve for opening and closing the passage.

4. Safety apparatus as claimed in claim 1, wherein a switch housing is adjacent the spool valve body and the spool operates the double switches.

5. Safety apparatus as claimed in claim 1, wherein the spool has a push rod and the switch has a plunger for operating the switches which is operated by the rod and a return coil spring for the spool valve is coaxial with the push rod.

6. Safety apparatus as claimed in claim 1, wherein conductors for the switches are presented as a socket on an assembly capable of cable connection to a switchboard of the machine.

7. Safety apparatus as claimed in claim 1, wherein connections of the double switch for supply of current for operation of the valves are via a certified safety system.

8. Safety apparatus as claimed in claim 1, wherein the spool valves are a pair of 3 port valves with pilot air operation.

9. Safety apparatus as claimed in claim 1, wherein the spool valves are a 3 port and a 5 port valve with pilot air operation.

10. Safety apparatus for controlling the supply of pressure fluid to a machine, comprising:

a first spool valve and a second spool valve connectable in series, and means for controlling the admission of pressure fluid to the machine, the means for controlling comprising a positive driven switch operable in association with spool position of either valve.

11. Safety apparatus as claimed in claim 10, wherein the means for controlling comprises a positive driven switch for each valve arranged to permit valve operation only when the spool of both valves are in a HOME position.

12. Safety apparatus as claimed in claim 10, wherein the valves are solenoid operated spool valves or solenoid operated pilot actuated spool valves.

13. Safety apparatus as claimed in claim 10, further wherein, in response to a START signal, fluid pressure is delivered to the first spool valve, the fluid pressure output of the first spool valve being deliverable to the second spool valve.

14. Safety apparatus as claimed in claim 10, further wherein the switch is adjacent a spool body and contacts of the switch are moved correspondingly with the spool position.

* * * * *